United States Patent [19]

Chen

[11] Patent Number: 5,029,700

[45] Date of Patent: Jul. 9, 1991

[54] RECEPTACLE AND AMUSEMENT DEVICE

[75] Inventor: Ying-Che Chen, South El Monte, Calif.

[73] Assignee: Great Truth Co., Ltd., South El Monte, Calif.

[21] Appl. No.: 530,624

[22] Filed: May 30, 1990

[51] Int. Cl.[5] ..... B65D 85/72

[52] U.S. Cl. ..... 206/217; 206/315.1; 215/6; 273/85 R; 446/71

[58] Field of Search ..... 206/217, 315.1, 579; 215/1 R, 6, 100 R; 273/1 R, 1.5 R, 85 R; 446/71, 75, 77

[56] References Cited

U.S. PATENT DOCUMENTS

| | | | |
|---|---|---|---|
| 2,975,547 | 3/1961 | Greeve | 446/77 |
| 3,623,728 | 3/1969 | Goldfarb | 206/315.1 |
| 4,095,792 | 6/1978 | Kanno | 273/85 R |
| 4,362,299 | 12/1982 | Suzuki | 273/85 R |
| 4,678,093 | 7/1987 | Allen | 215/100 R |
| 4,848,773 | 7/1989 | Lovik | 273/85 R |
| 4,932,542 | 6/1990 | Chen et al. | 446/77 |

*Primary Examiner*—Jimmy G. Foster
*Attorney, Agent, or Firm*—Ladas & Parry

[57] ABSTRACT

A receptacle for containing and receiving things includes a wall body confining a primary receiving space to contain the temporary contents of the receptacle such as beverage, and an enclosed section separated from the primary receiving space. The enclosed space has a transparent wall; at least one movable floating article contained inside the enclosed section and a device for impelling the floating article. Such receptacle can serve as a game while in use as a container.

19 Claims, 7 Drawing Sheets

RECEPTACLE AND AMUSEMENT DEVICE

BACKGROUND OF THE INVENTION

This invention relates to a receptacle, more particularly to a receptacle which provides amusing effects for the user.

Conventional receptacles such as cups, glasses, water canteens or even housings of pens or ballpens are plain looking, so some drawings are printed on the external surfaces of these receptacles. Those drawings are only decorative. They are static and monotonous.

SUMMARY OF THE INVENTION

It is therefore a main object of the present invention to provide a receptacle which will serve not only as a container but also as an amusement.

Another object of the present invention is to provide a receptacle which includes a primary receiving space to contain the temporary contents of the receptacle, such as beverages, and an enclosed section, the enclosed section having a transparent wall which contains at least one movable article, which article can be impelled by a device disposed on the transparent wall of the enclosed section of the receptacle, thus providing a source of amusement for the user.

In accordance with the present invention a receptacle for containing and receiving things includes a wall body having a projection extending inwardly from the internal wall surface, and defining a cavity extending inwardly into the projection and a transparent external wall disposed at the outer surface of the cavity thus confining said cavity. A plurality of floating articles is received inside the cavity, said floating articles can be driven to float around by a hand pump disposed on the transparent wall so as to enhance the amusing effects.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
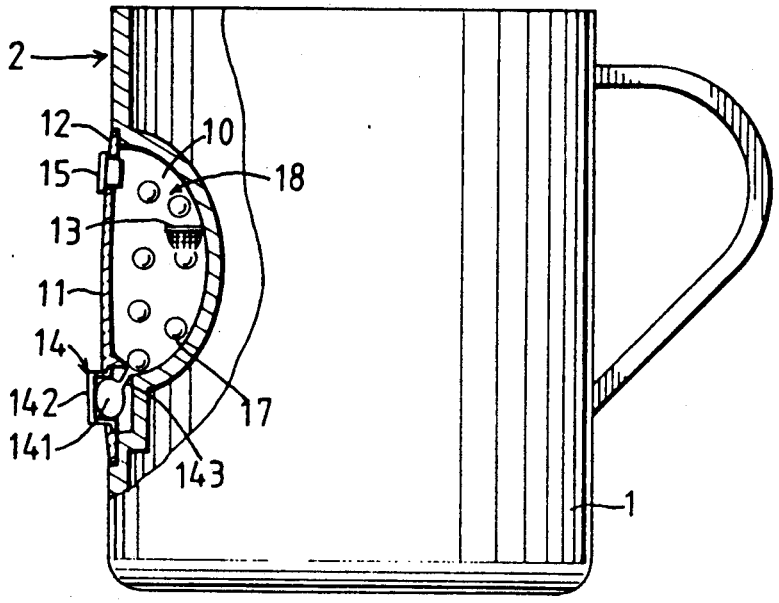
FIG. 1 is a partially sectional view of a first preferred embodiment of a receptacle according to this invention.
Figure 2:
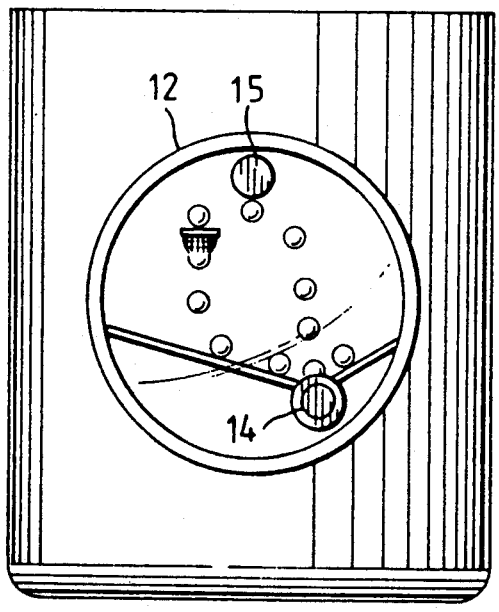
FIG. 2 is a plan view of the first preferred embodiment of a receptacle according to this invention.

Referring to FIGS. 1 and 2, a first preferred embodiment of the present invention is a cup 1 including a wall body 2 having a projection 18 extending inwardly from the internal wall surface thereof. A cavity 10 is formed in the concave surface of the projection 18 and a transparent external wall 11 is disposed at the outer surface 12 of the cavity 10 by a supersonic heat sealing process. A plurality of floating articles 17 is contained in the cavity 10 and a basket 13 including a net is fixedly mounted in the cavity 10. An inlet 15 for letting water into said cavity 10 is disposed at a position on the transparent wall 11 and a hand pump 14 is disposed at another position on the transparent wall 11. The cavity 10 is filled with water through the inlet 15 and is blocked by a plug. The hand pump 14 comprises a hollow body having a passage 143 connecting to the inside of the cavity 10, and said hollow body further having an expandable bag 141 and a acutuating member 142 to manually press the bag 141. The bag 141 is mostly made of flexible material so that it can regain its original shape whenever pressure is released from the acutuating member 14.

Figure 4:
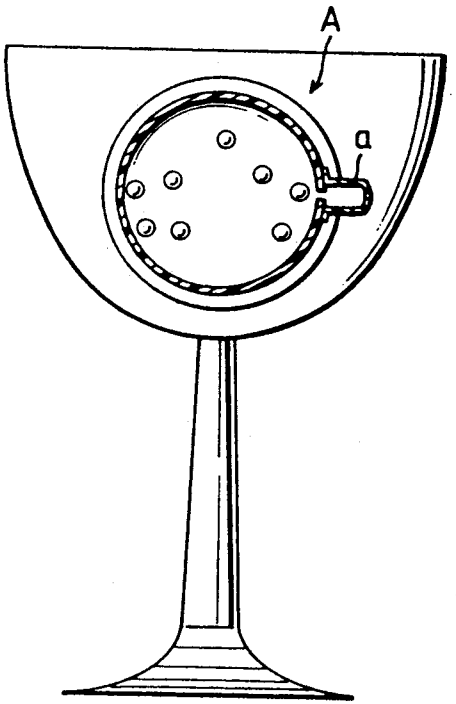
FIG. 4 is a schematic view of a third preferred embodiment of a receptacle according to this invention.
Figure 3:
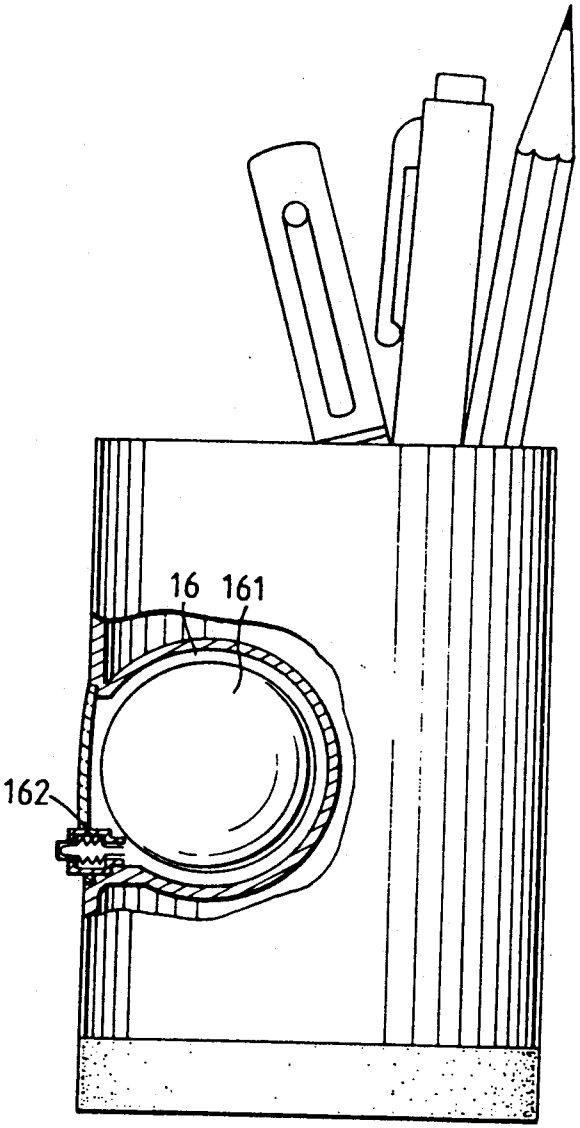
FIG. 3 is a partially sectional view of a second preferred embodiment of a receptacle according to this invention.

The hand pump and the floating article can be in various forms and shapes. The floating article 161 can be shaped for example like a big ball in the fluid 16 and the hand pump has an accordion like bag 162 connecting to the cavity of the wall body as best described in FIG. 3. Alternatively, the hand pump (a) is shaped like a rod as best described in FIG. 4. A shooting game can be play by pressing the hand pump impelling the floating articles to fall into a basket.

Figure 5:
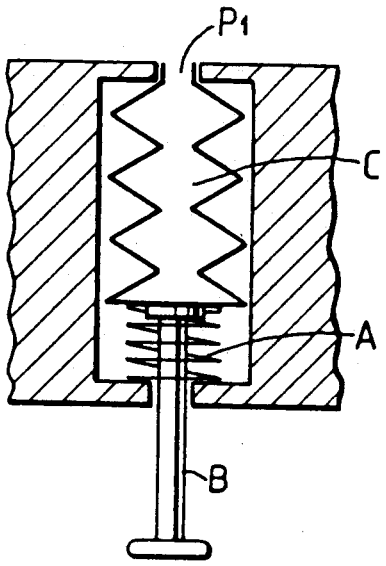
FIG. 5, is an enlarged view of the hand pump of a preferred embodiment of a receptacle according to this invention.
Figure 6:
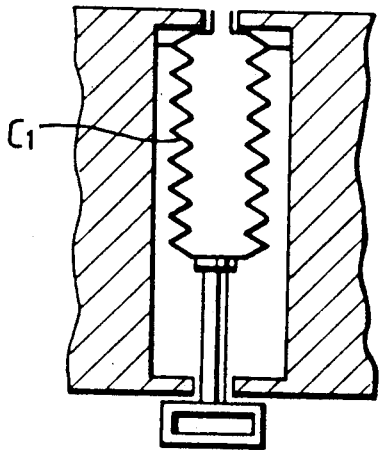
FIG. 6 is an enlarged view of another form of the hand pump of a preferred embodiment of a receptacle according to this invention.
Figure 7:
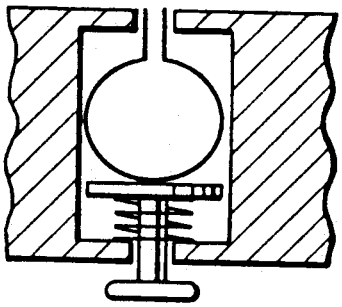
FIG. 7 is an enlarged view of still another form of hand pump of a preferred embodiment of a receptacle according to this invention.

Referring to FIG. 5 the hand pump is manually operated and it mainly comprises hollow bag C, a passage p1, a spring A assists the bag to regain its original shape when the imparted pressure is released from the actuating rod B. FIGS. 6 and 7 show another forms of a hand pump wherein the hollow bag C1 in FIG. 6 is self expanding, thus leaving no need for a spring. In FIG. 7 the bag is shaped like a bulb.

Figure 8:
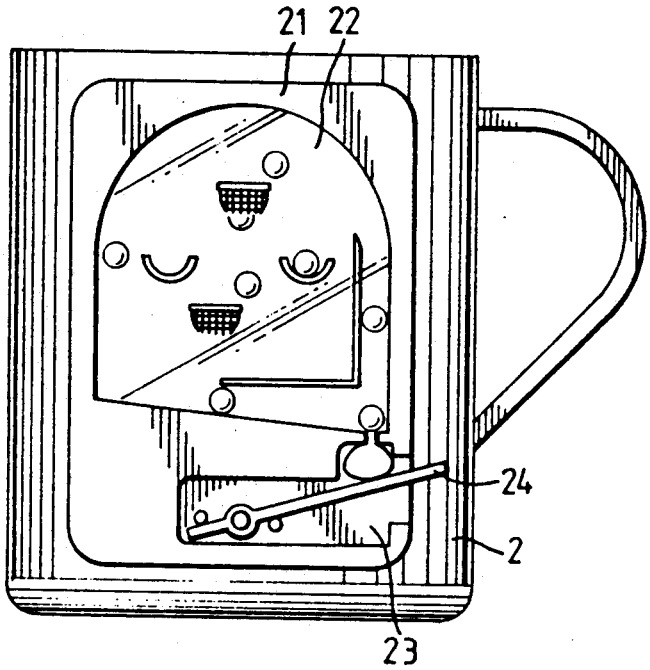
FIG. 8 is a side view of a fourth preferred embodiment of a receptacle according to this invention.
Figure 9:
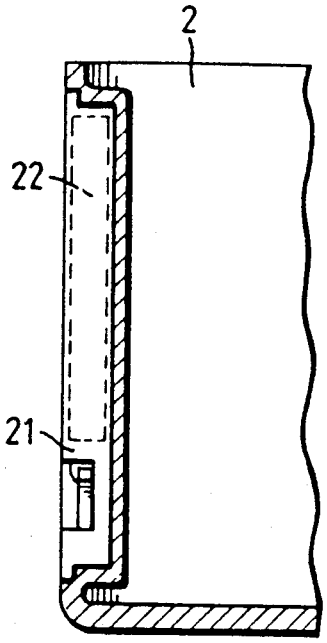
FIG. 9 is a partially sectional view of the fourth preferred embodiment of a receptacle according to this invention.
Figure 10:
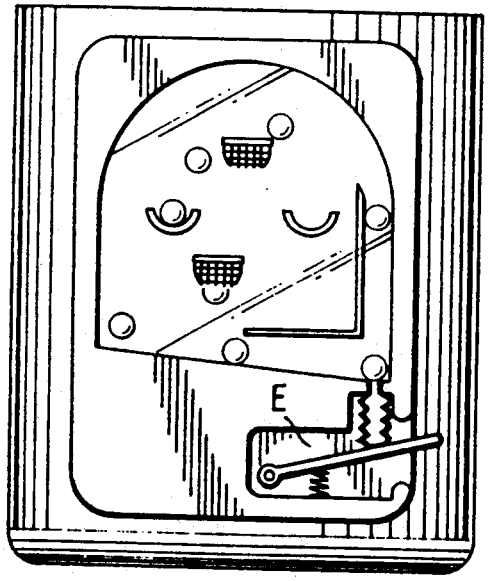
FIG. 10 is a side view of another form of the fourth preferred embodiment of a receptacle according to this invention.
Figure 11:
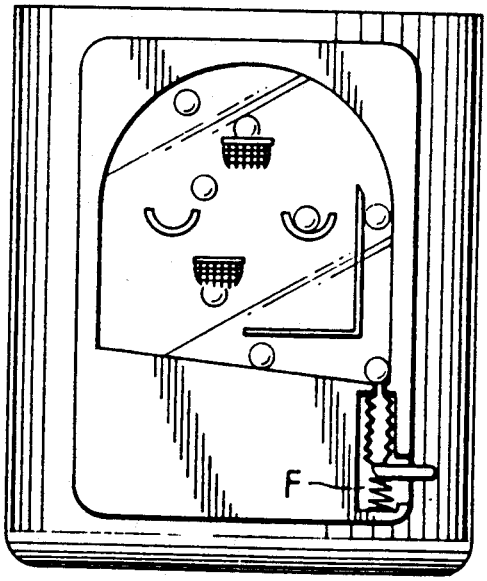
FIG. 11 is a side view of still another form of the fourth preferred embodiment of a receptacle according to this invention.
Figure 12:
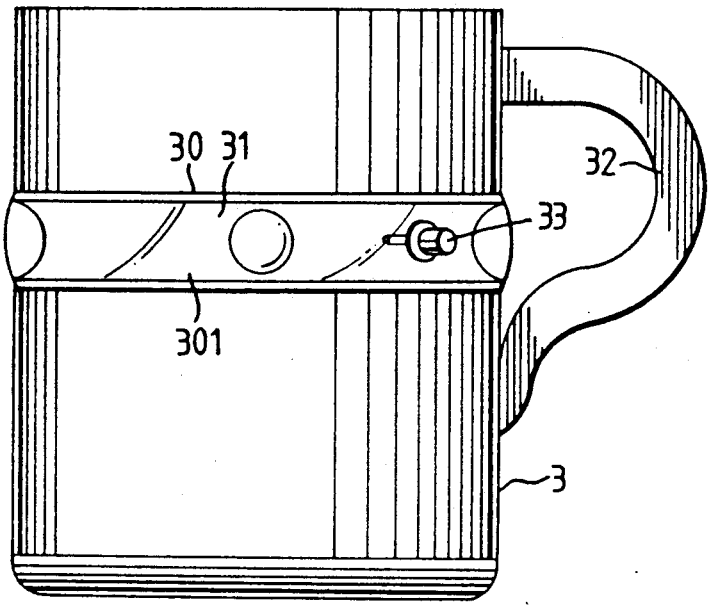
FIG. 12 is a side view of a fifth preferred embodiment of a receptacle according to this invention.
Figure 13:
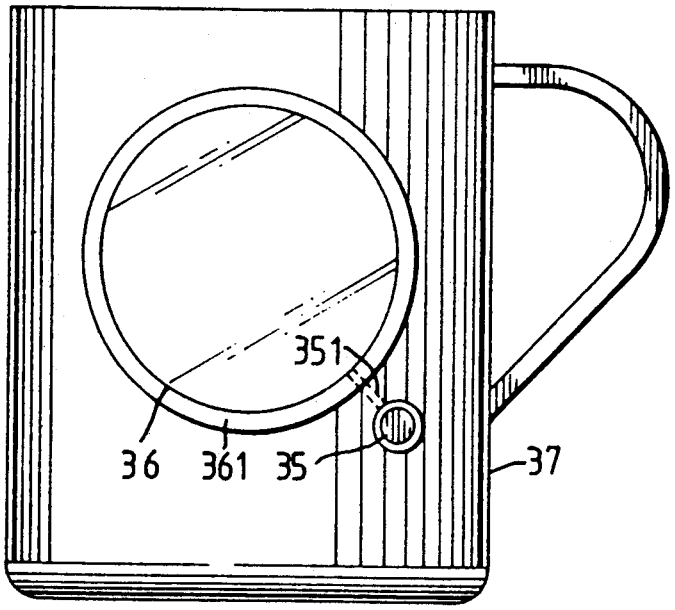
FIG. 13 is a side view of another form of the fifth preferred embodiment of a receptacle according to this invention.
Figure 14:
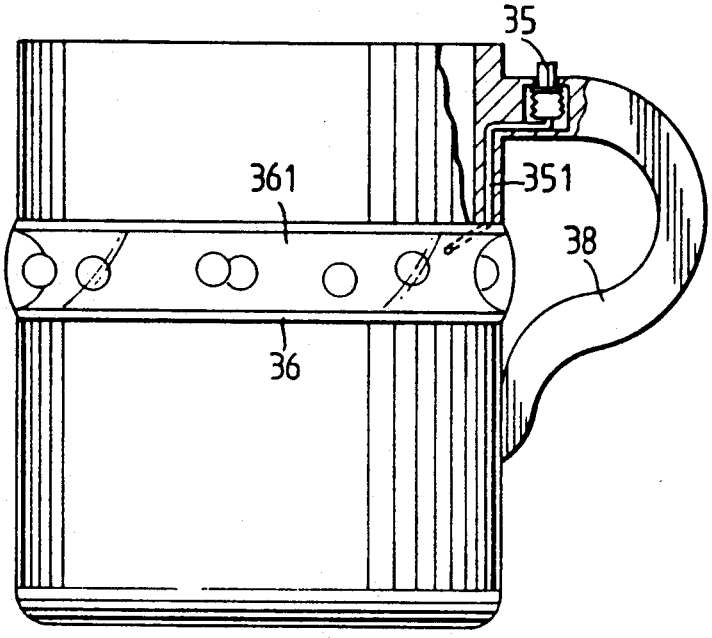
FIG. 14 is a partially sectional view of another form of the fifth preferred embodiment of a receptacle according to this invention.
Figure 15:
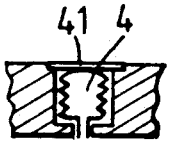
FIG. 15 is a detailed view of another form of the fifth preferred embodiment of a receptacle according to this invention.

Referring to FIGS. 8, 9, 10, and 11 wherein the hand pump 23 has an actuating rod 24 protruding outward from the transparent wall 21 of the cavity 22 of the wall body 2, said rod being anchored at two points and being made of flexible material so that the rod can serve as both the hand lever and assisting spring best shown in FIG. 8. Alternatively, said rod can be abutted by spring E as best shown in FIGS. 10 and 11. Apart from that, the cavity 31 of the wall body 3 of a receptacle having a handle 32, said cavity 31 being formed as a groove 301 on the outer surface of a receptacle and confined by a transparent wall 30 and a hand pump 33 disposed on it, said hand pump being connected to said cavity by a passage 331, as best shown in FIG. 12. In still another embodiment, the hand pump 35 can be disposed on the on the handle 38, connected to the groove 361 by passage 351 as shown in FIGS. 13 and 14 .The hand pump 4 can also be concealed under the handle by a seal plate 41 (shown in FIG. 15) so that the actuating lever of said hand pump is not readily noticeble thus arousing curiosity when the floating articles move in said groove.

Figure 16:
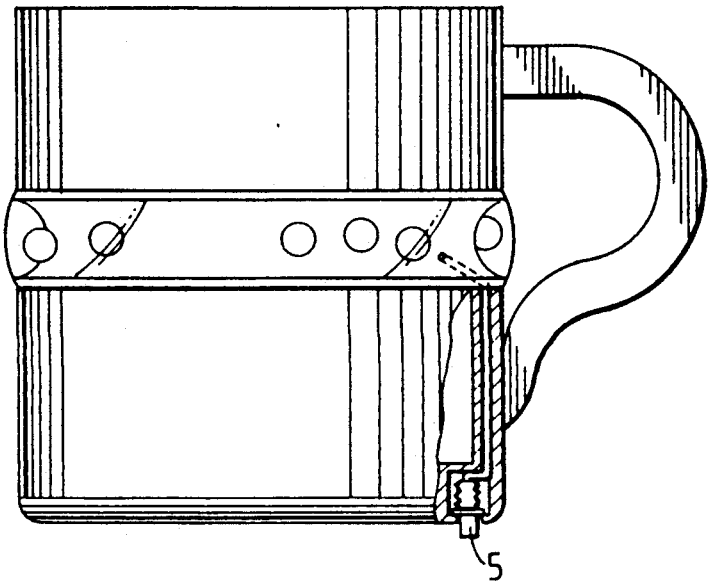
FIG. 16 is a partially sectional view of another form of the fifth preferred embodiment of a receptacle according to this invention.

Referring to FIG. 16, the hand pump 5 is disposed at the bottom of a cup so that the floating articles will be impelled by the simple act of putting the cup down.

Figure 17:
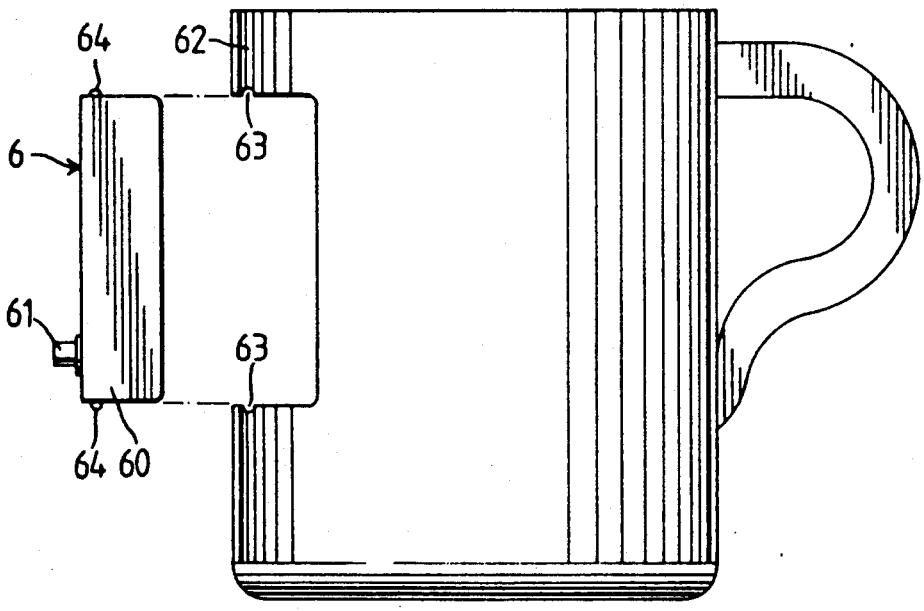
FIG. 17 is an exploded view the sixth preferred embodiment of a receptacle according to this invention.

Referring to FIG. 17 wherein two opposed grooves 63 are formed on the internal surface of the cup 62 into which are inserted a pair of protrusions 64 formed on the transparent wall 6 so that a cavity 60 is formed in between them, the hand pump 61 protrudes from said cavity 60.

While the invention has been described in connection with what is considered the most practical and preferred embodiment, it is understood that the invention is not limited to that disclosed embodiment, but on the contrary is intended to cover various modifications and equivalent arrangements included within the scope and spirit of the broadest interpretation so as to emcompass all such modifications and equivalent arrangements.

WHAT I CLAIM IS:

1. A receptacle for containing and receiving things, comprising:

a wall body confining a primary receiving space to contain the temporary contents of said receptacle, and an enclosed section separated from said primary receiving space, said enclosed section having a transparent wall; at least one article movably contained inside said enclosed section; and resilient means for moving said article.

2. A receptacle as claimed in claim 1, wherein said resilient means is a hand pump.

3. A receptacle as claimed in claim 2, wherein said enclosed section is filled with fluid.

4. A receptacle as claimed in claim 3, wherein said article is floatable.

5. A receptacle as claimed in claim 2, wherein said hand pump comprises:

a hollow body having a passage, said hollow body connected to said enclosed section of said wall body through said passage;

an expandable bag disposed inside said hollow body, said bag having two ends, one end having a through-hole connected to said passage; and an actuating member for manually compressing said bag.

6. A receptacle as claimed in claim 5, wherein said actuating member has a first end and a second end, said first end being joined with the other end of said bag, said second end protruding from said hollow body and said wall body.

7. A receptacle as claimed in claim 5, wherein said actuating member has a body portion with a first end and a second end, said first end protruding outward from said wall body, said second end being pivoted, and said body portion being adapted to engage the other end of said bag.

8. A receptacle as claimed in claim 5, wherein said actuating member has a first end and a second end, said first end protruding outward from an elongated through-hole formed on said wall body, said second end being biased by a spring and engaging the other end of said bag.

9. A receptacle as claimed in claim 5 wherein said bag is a retrievable bellows.

10. A receptacle as claimed in claim 5, wherein said bag is a retrievable bulb.

11. A receptacle for containing and receiving things, comprising:

a wall body confining a primary receiving space to contain the temporary contents of said receptacle, and an enclosed section separated from said primary receiving space, said enclosed section having a transparent wall;

at least one article movably contained inside said enclosed section; and a hand pump for moving said article.

12. A receptacle as claimed in claim 11, wherein said enclosed section is filled with fluid.

13. A receptacle as claimed in claim 12, wherein said article is floatable.

14. A receptacle as claimed in claim 11, wherein said hand pump comprises:

a hollow body having a passage, said hollow body connected to said enclosed section of said wall body through said passage;

an expandable bag disposed inside said hollow body, said bag having tow ends, one end having a through-hole connected to said passage; and an actuating member for manually compressing said bag.

15. A receptacle as claimed in claim 14, wherein said actuating member has a first end and a second end, said first end being joined with the other end of said bag, said second end protruding from said hollow body and said wall body.

16. A receptacle as claimed in claim 14, wherein said actuating member has a body portion with a first end and a second end, said first end protruding outward from said wall body, said second end being pivoted, and said body portion being adapted to engage the other end of said bag.

17. A receptacle as claimed in claim 14, wherein said actuating member has a first end and a second end, said first end protruding outward from an elongated through-hole formed on said wall body, said second end being biased by a spring and engaging the other end of said bag.

18. A receptacle as claimed in claim 14, wherein said bag is a retrievable bellows.

19. A receptacle as claimed in claim 14, wherein said bag is a retrievable bulb.

* * * * *